US005633646A

United States Patent [19]

Strickland

[11] Patent Number: 5,633,646

[45] Date of Patent: May 27, 1997

[54] MINI-CAP RADIATING ELEMENT

[75] Inventor: Peter C. Strickland, Ottawa, Canada

[73] Assignee: CAL Corporation, Ottawa, Canada

[21] Appl. No.: 567,986

[22] Filed: Dec. 11, 1995

[51] Int. Cl.[6] ..... H01Q 1/38

[52] U.S. Cl. ..... 343/700 MS; 343/846

[58] Field of Search ..... 343/700 MS, 846, 343/829, 789; H01Q 1/38

[56] References Cited

U.S. PATENT DOCUMENTS 5,061,938 10/1991 Zahn et al. ..... 343/700 MS 5,442,366 8/1995 Sanford ..... 343/700 MS

*Primary Examiner*—Hoanganh T. Le

*Attorney, Agent, or Firm*—Pascal & Associates

[57] ABSTRACT

An antenna radiator comprising a rectangular conductive cap disposed over a top of a dielectric, the cap having an extension over a side of the dielectric, apparatus for feeding energy to the radiator adjacent an end of the extension remote from the cap, and a ground plane spaced from and parallel to the cap, below the dielectric.

23 Claims, 5 Drawing Sheets

MINI-CAP RADIATING ELEMENT

FIELD OF THE INVENTION

This invention relates to the field of microwave antennas and in particular to a low profile relatively broadbeam antenna radiator.

BACKGROUND TO THE INVENTION

Low profile antenna radiating elements generally produce a relatively narrow beam centered at broadside. This limits the ability of phased arrays of the radiating elements to scan at low elevation angles.

The microstrip patch antenna formed of plural conductive layers on a plastic substrate, is a design which attempts to overcome the above problems. However this form of element is also very large, and has a beamwidth which is too narrow for scanning to low angles, i.e. close to the horizon.

SUMMARY OF THE INVENTION

The present invention is an antenna radiator which has a small surface area, and thus allows close element spacing. It has a beamwidth which is adequate for scanning small horizontal arrays to the horizon. In addition, the radiating element is circularly polarizable and is broadband. The present invention has a much smaller radiator size than conventional radiating elements at a given frequency, and has a much broader beamwidth. It can be used in an array scanned through larger angles than previous such arrays, without exciting grating lobes, and while maintaining low sidelobe levels. Accordingly the element is suitable for use for mobile satellite communications at L-band (1525–1661 MHz).

In accordance with an embodiment of the invention, an antenna radiator is comprised of a rectangular conductive cap disposed over a top of a dielectric, the cap having an extension over a side of the dielectric, apparatus for feeding energy to the radiator adjacent an end of the extension remote from the cap, and a ground plane spaced from and parallel to the cap, below the dielectric.

BRIEF INTRODUCTION TO THE DRAWINGS

A better understanding of the invention will be obtained by considering the detailed description below, with reference to the following drawings, in which:

FIGS. 1, 2 and 3 are isometric views of three embodiments of the invention, respectively, FIGS. 4, 5 and 6 are composite plan and side elevation views of variations of the three embodiments of the invention, FIG. 7 is an isometric view of plural radiating elements in an array, FIG. 8 is a plot of an antenna radiation pattern of a conventional microstrip patch antenna radiating element, and FIG. 9 is a plot of an antenna radiation pattern of an embodiment of the present invention.

DETAILED DESCRIPTION OF EMBODIMENTS OF THE PRESENT INVENTION

Figure 1:
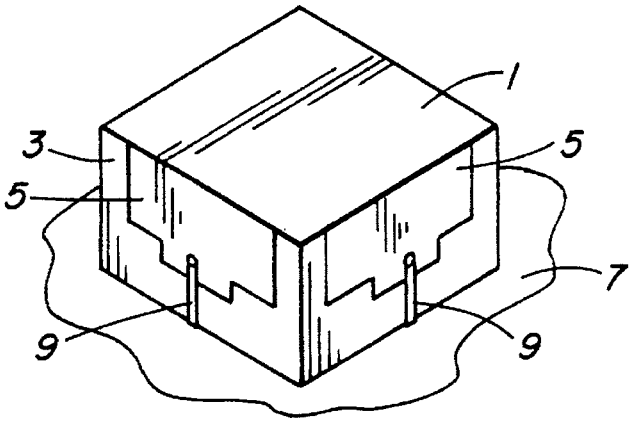
Figure 2:
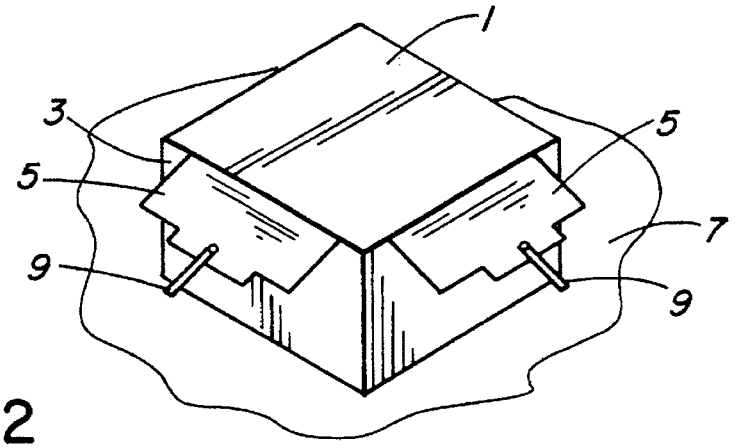
Figure 3:
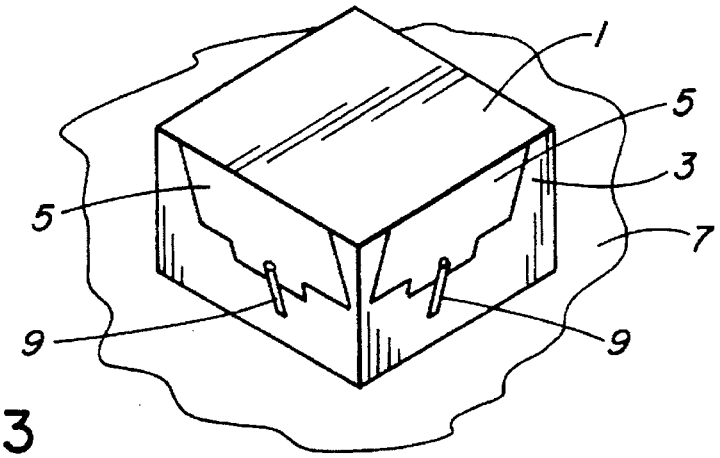

FIGS. 1, 2 and 3 illustrate the invention as can be used to provide circular polarization or dual orthogonal linear polarization. The structure is comprised of a rectangular conductive cap 1 which is disposed over a dielectric 3. Extensions 5 from the cap 1 are disposed at the sides of the dielectric 3. The dielectric is located above a conductive ground plane 7. The widths of the extensions may be narrower than the adjacent side widths of the cap 5.

Extending from the cap 1, on sides opposite to the feed points, are loading elements, preferably loading stubs (not seen in FIGS. 1, 2 and 3, but which will be described with reference to other embodiments).

Circular polarization is achieved by feeding each of the extensions, preferably via feed pins 9, with signals which are of equal magnitude but are 90 degrees out of phase. Linear polarization is achieved by feeding the element at only one point, i.e. at only one of the pins 9, or by feeding both feed pins in phase.

It should be noted that four feed pins can be used, one on each side. A pair of feed pins on opposite sides from each other would be excited for each mode of excitation.

In the embodiment of FIG. 1, the extensions 5 are at 90 degrees to the plane of the cap 1. In the embodiments of FIGS. 2 and 3, the extensions 5 are at less than 90 degrees and more than 90 degrees to the plane of the cap 1, respectively. The embodiments of FIGS. 2 and 3 can provide improved axial ratios in some planes at low elevation angles.

The dielectric can be air, foam, honeycomb or a solid, such as a polyolefin.

The radiating elements are uniquely small in size for a given resonant frequency, and which is particularly useful in the design of phase scanned arrays. Typical dimensions of the radiator as ratios to the free space wavelength at the operating frequency, for an air dielectric, are: length: 0.2; width: 0.2; height above the ground plane: 0.13. This compares with a conventional radiating element such as a microstrip patch radiator, with an air dielectric, in which the corresponding ratios are: length: 0.45; width: 0.45; height: 0.07.

It may be seen that with the length and width of radiators of the present invention being less than half the corresponding dimension of patch antenna radiators, less than one quarter the ground plane surface area is required, allowing more radiators to be used in an array for a given space than in a patch antenna array.

Figure 8:
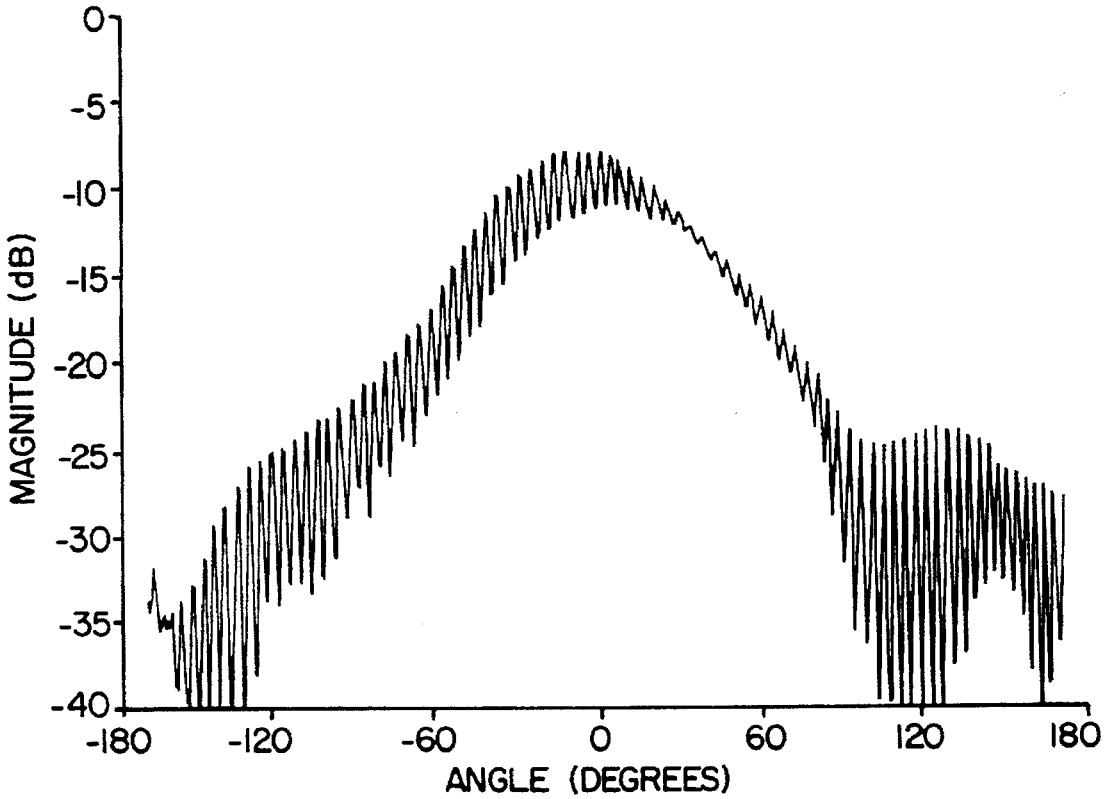
Figure 9:
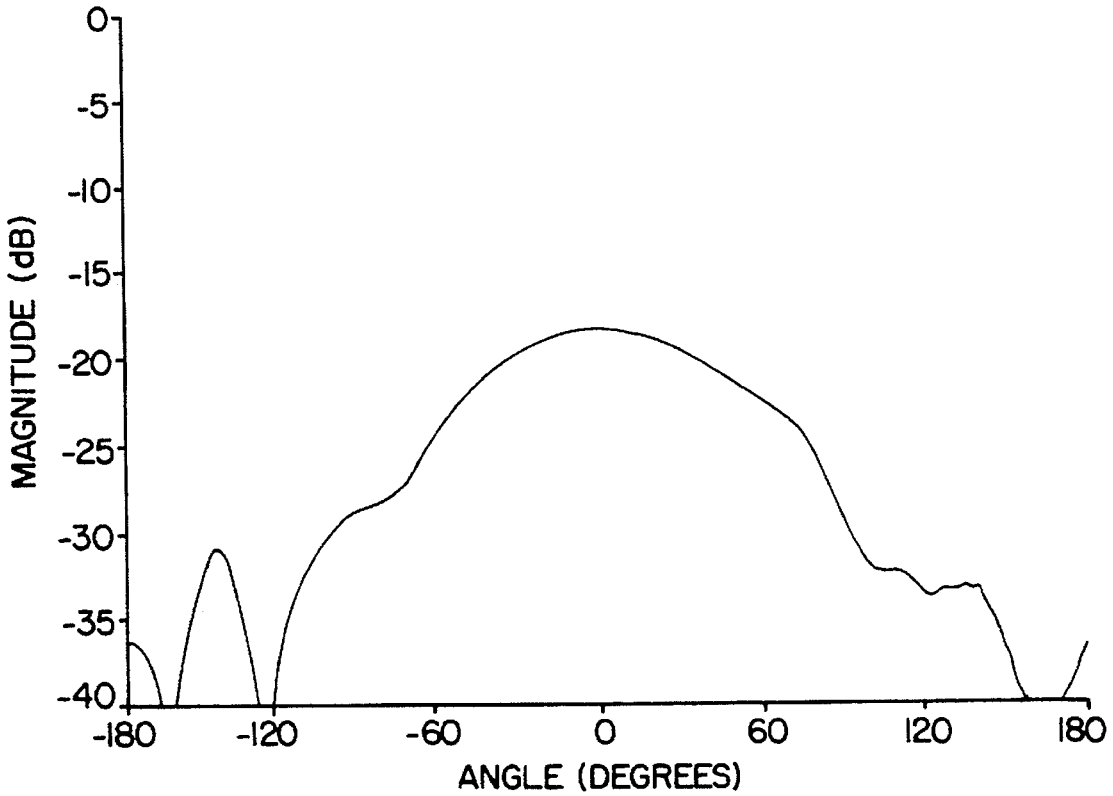

A measured radiation pattern of a prior art patch antenna radiator on a polyolefin substrate is shown in FIG. 8, and a measured radiation pattern of a prototype antenna radiator of the present invention using an air dielectric is shown in FIG. 9. Both were fed signals which provided right hand circular polarization.

The patch antenna element has a half power beamwidth of only approximately 63 degrees, while the half power beamwidth of the present invention is approximately 94 degrees. It has been determined that if the present invention had a polyolefin dielectric its beamwidth would have been even larger than 94 degrees.

Elements can be packed close together, allowing phased arrays to scan to very large angles off of boresight without exciting grating lobes and while maintaining low sidelobe levels.

Figure 4:
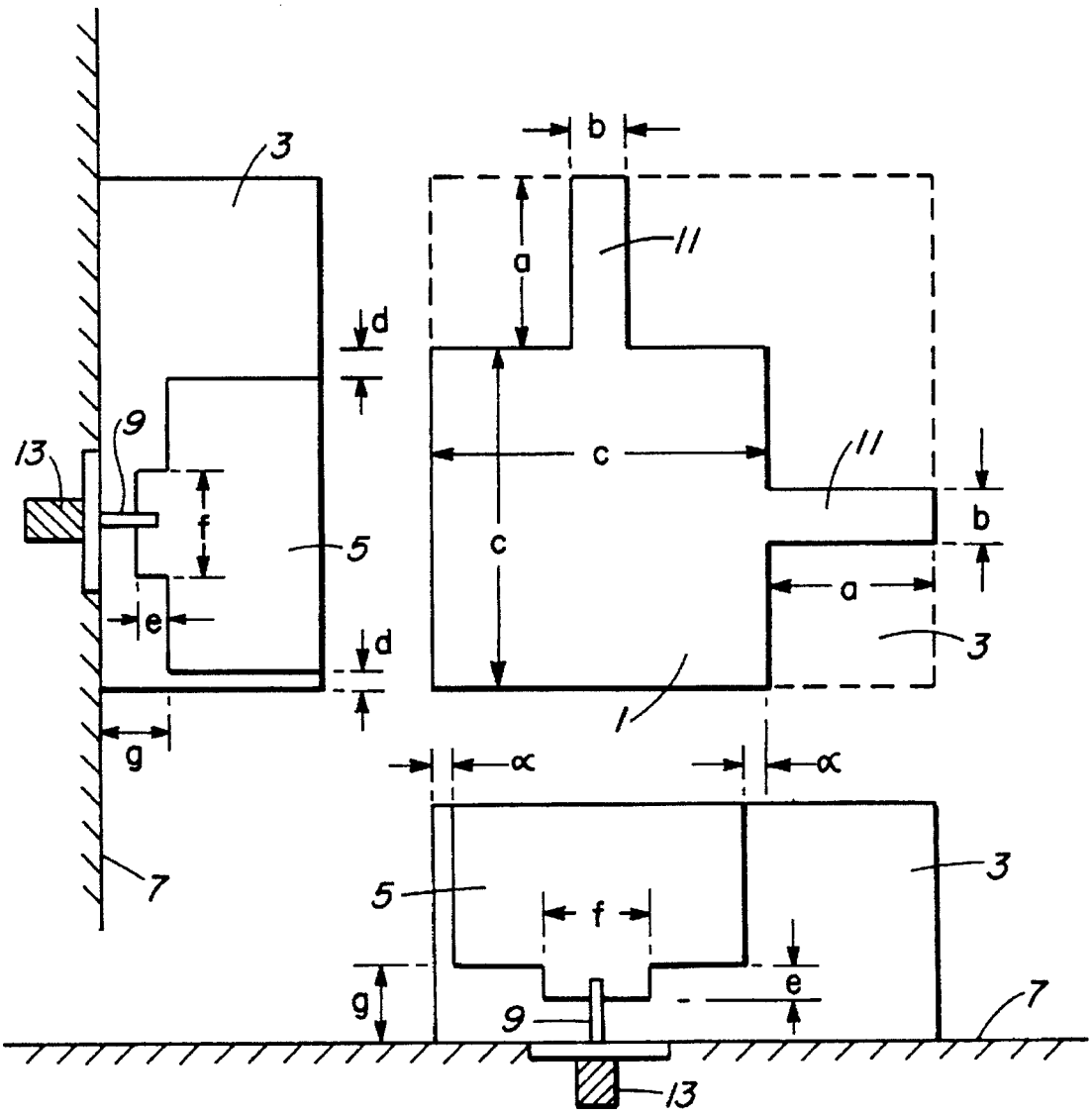

Turning now to FIG. 4, more detailed plan and elevation views are illustrated of the embodiment of FIG. 1. The loading elements in the form of stubs 11 extend from the conductive cap 1, in the same horizontal plane as the cap. The pins are soldered to the extensions 5, and are connected to connectors 13 which are supported by the ground plane or from a support for the ground plane.

Preferred dimensions identified by letter for each part of the radiator are as follows, for a frequency band of 1525–1661 MHz: (a): 18 mm; (b): 5 mm; (c): 38 mm; (d): 3 mm; (e): 3 mm; (f); 12.7 mm and (g): 8 mm. The input impedance of a prototype radiating element made in accordance with the above dimensions was about 280 ohms. The feedpoint at the bottom of the figure was excited 90 degrees out of phase from the feedpoint at the side of the figure.

The dielectric can be air, or a solid dielectric. If the dielectric is air, the structure can be supported by the pins 9 and connectors 13. If the dielectric is solid, the dielectric can provide structural support. A solid dielectric will reduce the resonant frequency of the radiating element.

While the dielectric and the cap are described as being rectangular in shape it is intended that "rectangular" should be construed as meaning either square or rectangular, square being only special dimensions of rectangularity.

The conductive ground plane can be a flat sheet of copper, copper that is plated with tin or gold or other conductive material. This conductive sheet can be laminated to fiberglas or some other dielectric sheet. The ground plane provides a return current path and also blocks back radiation.

The extensions to the cap, the cap, and the loading stubs are preferably formed of a continuous conductive material, which sits over the dielectric (or dielectric block, if solid). Alternatively, they can be formed of conductive material deposited and retained on the surface of the dielectric material.

During operation, currents from all portions of the conductive material radiate, as do displacement currents in the dielectric.

It should be noted that the extensions 5 are important aspects of the design, since they increase the vertical component of the radiated field relative to that of conventional elements, particularly at low elevation angles. They also reduce the input impedance of the element to a value which can be impedance matched over a broad frequency band. They also provide connection points to the connector 13.

While each of the extensions 5 perform similar functions, the use of the two extensions allow circular polarization with relative 90 degree phase excitation, and also allow dual orthogonal linear polarization with in-phase excitation of both.

The loading stubs provide capacitive loading on the radiator, reducing the resonant frequency, and reducing the coupling between the two feed points.

Figure 5:
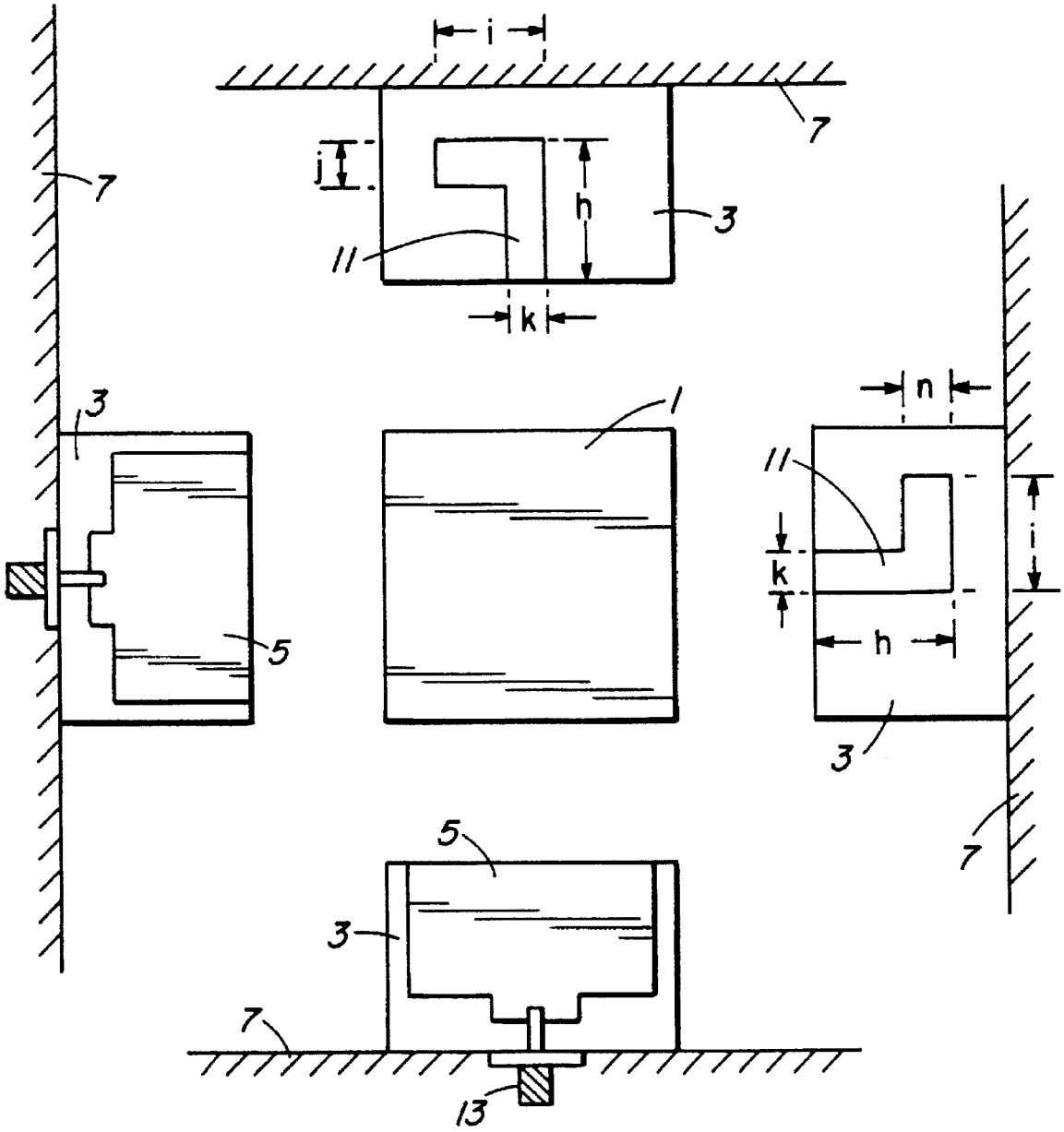

FIG. 4 illustrates horizontal loading, wherein the loading stubs 11 are in the same plane as the cap 1, and extend over part of, and to the edges of, the dielectric 3. FIG. 5 illustrates vertical loading, wherein the loading stubs 11 extend along the sides of the dielectric 3. In this embodiment, the cap 1 covers the top of the dielectric completely. FIG. 5 also illustrates that the stubs need not be rectangular in shape as in FIG. 4, but may be L-shaped. Indeed, any suitable shape of loading stub can be used.

The dimensions of the embodiment of FIG. 5 for the frequency given above, are the same as the embodiment of FIG. 4, except for the substitution of the following dimensions: (h): 18 mm; (i): 15 mm; (j): 6 mm and (k): 5 mm.

Figure 6:
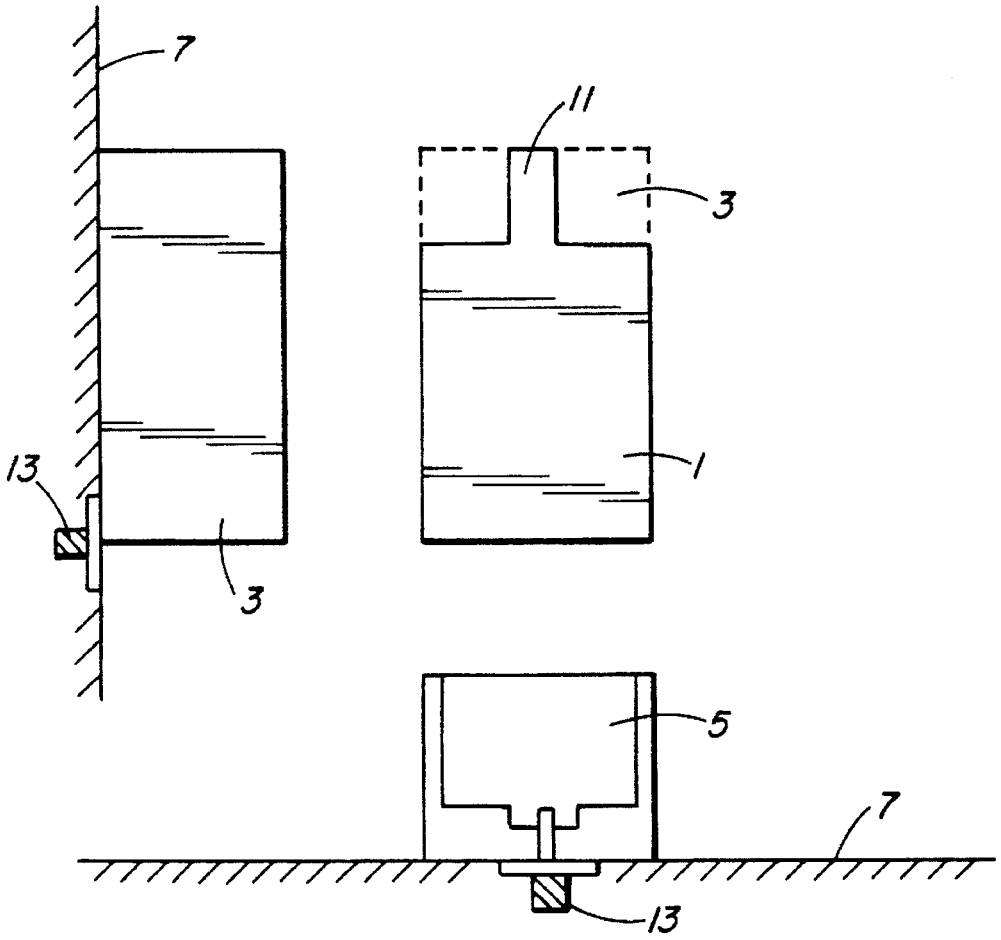

FIG. 6 illustrates another embodiment of the invention. In this case, only one extension 5 of the cap 1 is used, and only one loading stub 11. While horizontal loading is shown, vertical loading, as shown in FIG. 5 could be used. In this embodiment, the single connector 13 is excited, resulting in linear polarization.

Figure 7:
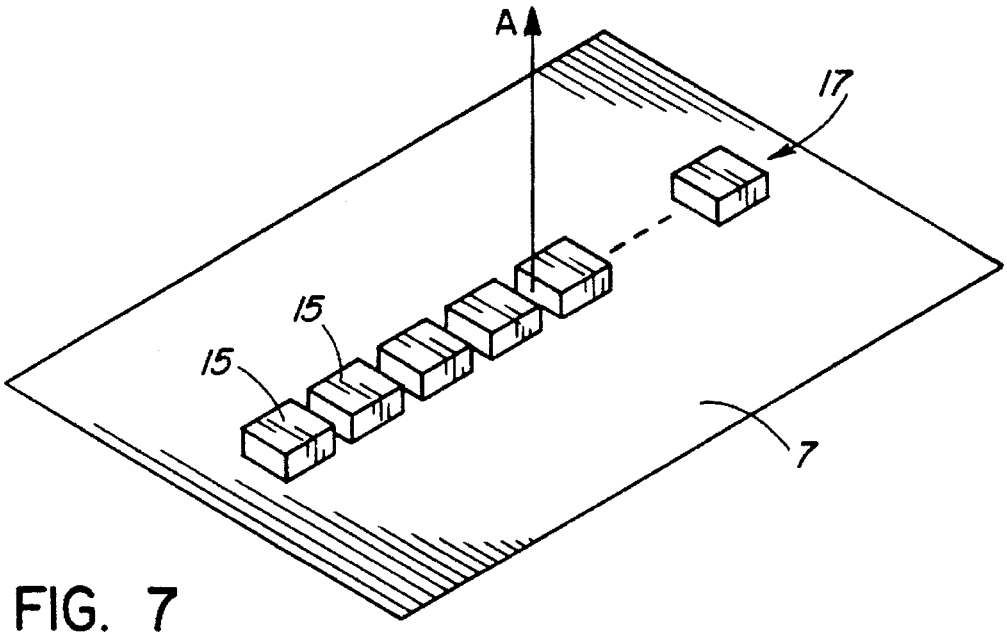

FIG. 7 illustrates plural closely packed radiators, each as any of the radiating elements described above, fixed above a ground plane 7. The array can be scanned in a well known manner, but in accordance with the present invention, the useful bandwidth can be relatively broad. The array can scan to very large angles off the boresight A, as noted earlier, and as illustrated in FIG. 9.

A person understanding this invention may now conceive of alternative structures and embodiments or variations of the above. All those which fall within the scope of the claims appended hereto are considered to be part of the present invention.

I claim:

1. An antenna radiator comprising a rectangular conductive cap disposed over a top of a dielectric, the cap having an extension over a side of the dielectric, means for feeding energy to the radiator adjacent an end of the extension remote from the cap, a ground plane spaced from and parallel to the cap, below the dielectric, and a loading element extending from a side of the cap opposite said extension in the same plane as the cap, over the dielectric.

2. A radiator as defined in claim 1 in which said extension is in a plane orthogonal to the plane of the cap.

3. A radiator as defined in claim 1 in which said extension is less than 90 degrees from the plane of the cap.

4. A radiator as defined in claim 1 in which said extension is more than 90 degrees from the plane of the cap.

5. A radiator as defined in claim 1 in which the loading element is rectangular.

6. A radiator as defined in claim 1 in which the loading element is L shaped.

7. A radiator as defined in claim 1 in which the cap, extension and loading element are formed of a stamped and bent conductor sheet having a size and shape such as to cover the dielectric.

8. A radiator as defined in claim 1 in which the cap and extension are formed of a metalized layer disposed on and supported by a preformed plastic dielectric.

9. An antenna radiator comprising a rectangular conductive cap disposed over a top of a dielectric, the cap having an extension over a side of the dielectric, means for feeding energy to the radiator adjacent an end of the extension remote from the cap, a ground plane spaced from and parallel to the cap, below the dielectric, and a loading element extending from a side of the cap opposite said extension in a plane orthogonal to the plane of the cap, over a side of the dielectric.

10. A radiator as defined in claim 9, in which the dielectric is comprised of one of air, a solid, foam and honeycomb material.

11. A radiator as defined in claim 10 in which the ratio of length of the cap to free space wavelength is about 0.2, the ratio of the width of the cap to free space wavelength is about 0.2, and the ratio of the height of the cap above the ground plane to free space wavelength is about 0.13.

12. A radiator as defined in claim 9 in which the dielectric is comprised of a polyolefin.

13. A radiator as defined in claim 9 in which the loading element is rectangular.

14. A radiator as defined in claim 9 in which the loading element is L shaped.

15. A radiator as defined in claim 9 in which the cap, extension and loading element are formed of a stamped and bent conductor sheet having a size and shape such as to cover the dielectric.

16. An antenna radiator comprising a rectangular conductive cap disposed over a top of a dielectric, the cap having an extension over a side of the dielectric, means for feeding energy to the radiator adjacent an end of the extension remote from the cap, a ground plane spaced from and parallel to the cap, below the dielectric, and a pair of extensions from adjacent sides of the cap over adjacent sides of the dielectric, loading elements extending from the cap at sides opposite said extensions, and means for feeding energy to respective ends of said extensions.

17. A radiator as defined in claim 16 including means for feeding signals 90 degrees out of phase to respective ones of said feeding means.

18. A radiator as defined in claim 16 in which the loading elements are in the same plane as the cap, over the dielectric.

19. A radiator as defined in claim 16 in which the loading elements are in a plane orthogonal to the plane of the cap, over a side of the dielectric.

20. A radiator as defined in claim 16, in which the dielectric is comprised of one of air, a solid, foam and honecomb material.

21. A radiator as defined in claim 16 in which the dielectric is comprised of a polyolefin.

22. A radiator as defined in claim 16 in which the extension is slightly narrower than the width of the side of the cap from which it extends.

23. A radiator as defined in claim 16 including means for supporting the cap from feed connectors fixed to at least one of the ground plane and ground plane supporting means.

* * * * *